US006547518B1

(12) United States Patent
Czachor et al.

(10) Patent No.: US 6,547,518 B1
(45) Date of Patent: Apr. 15, 2003

(54) LOW HOOP STRESS TURBINE FRAME SUPPORT

(75) Inventors: Robert Paul Czachor, Cincinnati, OH (US); Steven Andrew Strang, Loveland, OH (US)

(73) Assignee: General Electric Company, Schenectady, NY (US)

( * ) Notice: Subject to any disclaimer, the term of this patent is extended or adjusted under 35 U.S.C. 154(b) by 225 days.

(21) Appl. No.: 09/827,850

(22) Filed: Apr. 6, 2001

(51) Int. Cl.[7] ..... F01D 9/04
(52) U.S. Cl. ..... 415/137; 415/209.4
(58) Field of Search ..... 415/136, 137, 415/142, 209.2, 209.3, 209.4, 189, 190

(56) References Cited

U.S. PATENT DOCUMENTS

| | | | |
|---|---|---|---|
| 4,571,936 | A | 2/1986 | Nash et al. |
| 4,907,946 | A | 3/1990 | Ciokajlo et al. |
| 4,989,406 | A | 2/1991 | Vdoviak et al. |
| 5,165,850 | A | 11/1992 | Humke et al. |
| 5,249,921 | A | 10/1993 | Stueber et al. |
| 5,272,869 | A | 12/1993 | Dawson et al. |
| 5,597,286 | A | 1/1997 | Dawson et al. |
| 5,634,767 | A | 6/1997 | Dawson |

*Primary Examiner*—Edward K. Look
*Assistant Examiner*—Kimya N McCoy
(74) *Attorney, Agent, or Firm*—Nathan D. Herkamp; Steven J. Rosen

(57) ABSTRACT

A gas turbine frame has inner and outer annular bands, respectively, joined together by generally radially extending struts therebetween. A radially outer conical support arm extends radially outwardly from the outer band and a radially inner conical support arm extends radially inwardly from the inner band. Circumferentially spaced apart inner and outer openings are disposed in the inner and outer conical support arms, respectively. Each of the struts has at least one radially extending hollow passage which extends through the inner and outer bands. The frame is a single piece integral casting. The inner and outer conical support arms have an equal number of the inner and outer circumferentially spaced apart openings. The inner circumferentially spaced apart openings are equi-angularly spaced apart and the outer circumferentially spaced apart openings are equi-angularly spaced apart. Each pair of the inner and outer circumferentially spaced apart openings are linearly aligned with the hollow passage of a corresponding one of the struts.

54 Claims, 8 Drawing Sheets

LOW HOOP STRESS TURBINE FRAME SUPPORT

BACKGROUND OF THE INVENTION

1. Field of the Invention

This invention relates to gas turbine engine frames and, in particular, to supporting gas turbine engine turbine frames from radially outer casings.

2. Discussion of the Background Art

Gas turbine engines and, in particular, aircraft gas turbine engines employ two or more structural assemblies, referred to and known as frames, to support and accurately position the engine rotor within the stator. Each frame includes an inner ring and an outer ring connected by a number of radial struts extending therebetween and contoured for minimum interference with the engine flow. The outer ring is connected to an engine inner casing by a radially outer conical support arm and a radially inner conical support arm support is used for supporting a bearing assembly. The radially inner conical support arm support is typically connected and used to support a sump of the bearing assembly. In some engine designs, the inner casing is mounted within and to an outer engine casing by links. Hollow passage are often provided through the strut to pass service lines such as sump service tubes and also sometimes to pass cooling air across hot working gas flow contained in a turbine flowpath between the inner and outer rings and the radial struts.

The radially outer and inner conical support arms are exposed to high temperatures, transmit loads, and are continuous hoops subject to hoop stress. The hoop stress is due to substantial operating temperature differentials between the frame and the bearing and between the frame and the inner casing. It is desirable to have a design for the radially outer and inner conical support arms of the frame and turbine assembly that reduces or eliminates these hoop stresses in the support arms.

SUMMARY OF THE INVENTION

In the exemplary embodiment of the present invention as illustrated herein, a gas turbine frame has inner and outer annular bands, respectively, joined together by generally radially extending struts therebetween. A radially outer conical support arm extends radially outwardly from the outer band and a radially inner conical support arm extends radially inwardly from the inner band. Circumferentially spaced apart inner and outer openings are disposed in the inner and outer conical support arms, respectively. Each of the struts has at least one radially extending hollow passage which extends through the inner and outer bands. The frame is a single piece integral casting. The inner and outer conical support arms have an equal number of the inner and outer circumferentially spaced apart openings. The inner circumferentially spaced apart openings are equi-angularly spaced apart and the outer circumferentially spaced apart openings are equi-angularly spaced apart. Each pair of the inner and outer circumferentially spaced apart openings are linearly aligned with the hollow passage of a corresponding one of the struts.

In one particular embodiment of the invention, each opening has a substantially rectangular platform shape with rounded forward and aft ends and, in another embodiment, each opening has a substantially triangular platform shape with filleted corners.

The frame of the present invention provides a structural connection between the relatively cool engine casing and the inner sump of the bearing across a relatively hot flowpath while avoiding destructive levels of thermal hoop stress which occur in prior art designs. The invention also can improve the castability of the one piece integrally cast frame of the invention by providing openings into narrow cavities between the bands and the support arms. This feature eases production of the investment casting. The invention may also provide thermal flexibility which also improves castability by reducing the propensity for hot tearing of a casting alloy during solidification. The cutouts or openings also provide access to strut ends for inserting sump service tubing.

BRIEF DESCRIPTION OF THE DRAWINGS

The foregoing aspects and other features of the invention are explained in the following description, taken in connection with the accompanying drawings where.

DETAILED DESCRIPTION

Figure 1:
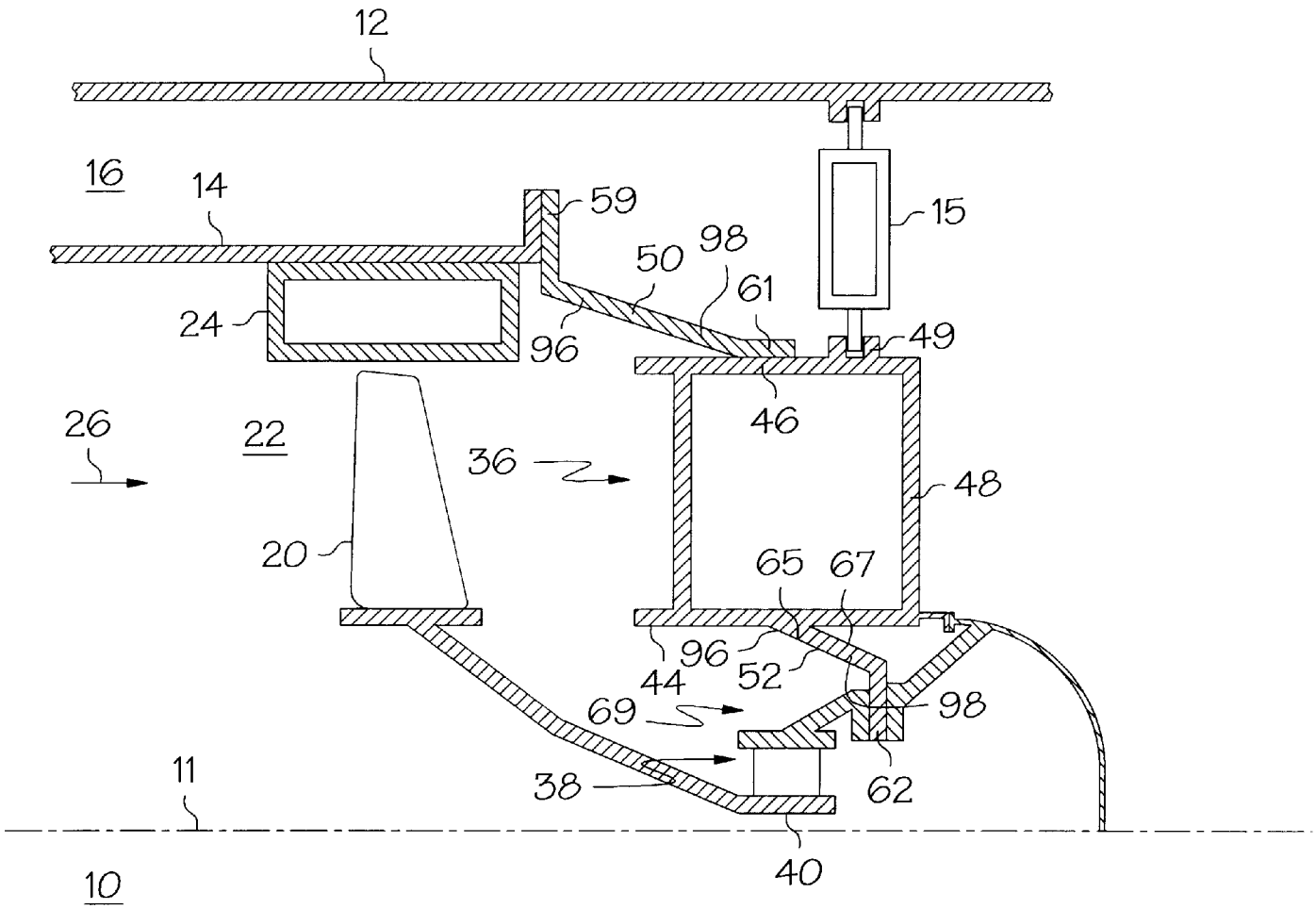
FIG. 1 is a schematic illustration of an axial flow gas turbine engine including an exemplary turbine frame of the present invention.
Figure 2:
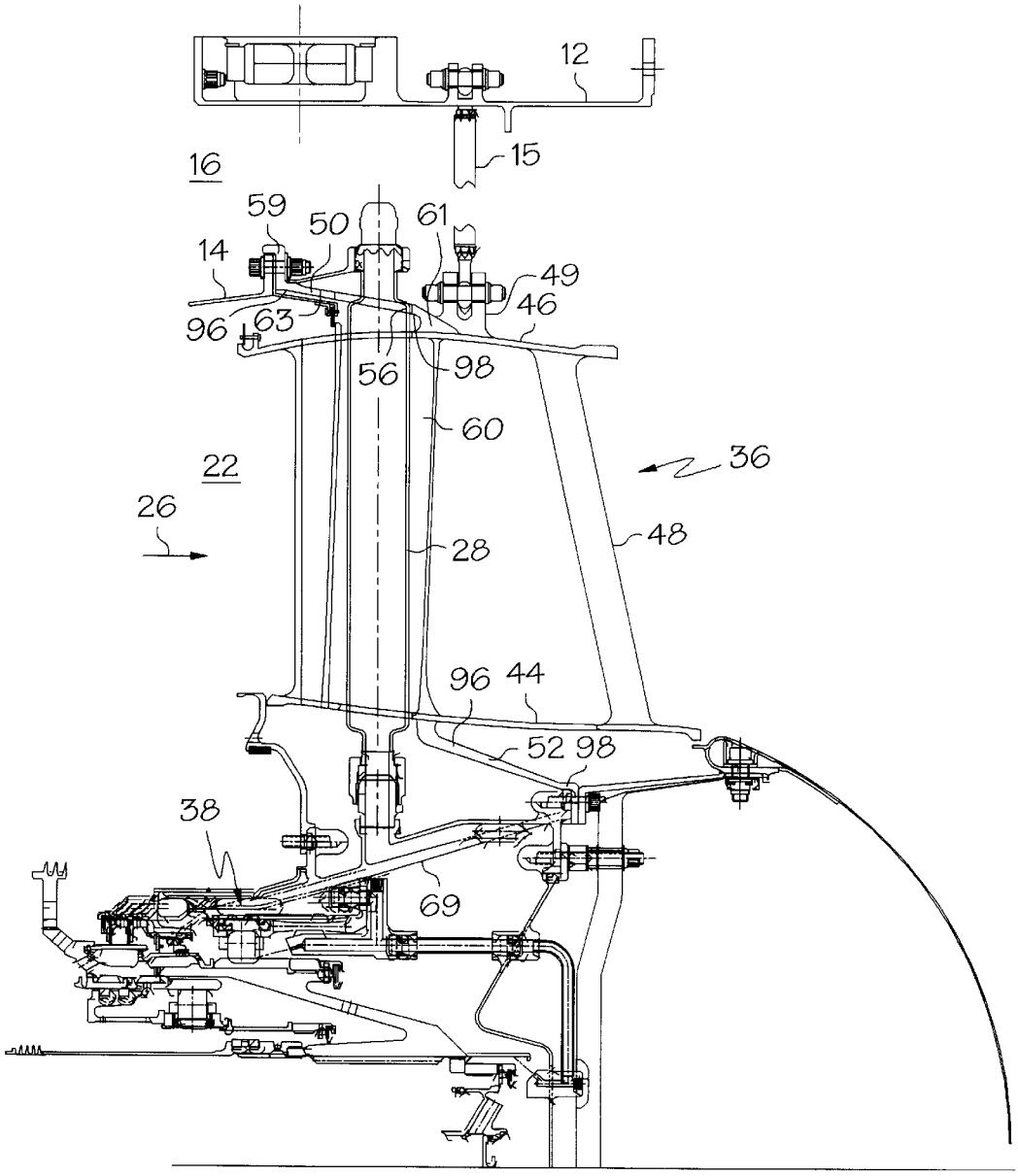
FIG. 2 is a more detailed cross-sectional view illustration of a portion of the engine and turbine frame illustrated in FIG. 1 with links extending radially between a radially outer annular band of the frame and an engine outer casing.

An exemplary embodiment of the invention is illustrated schematically in FIG. 1 and in more detail in FIG. 2. A portion of a turbine section 10 of a gas turbine or turbofan engine includes an engine outer casing 12 radially spaced outwardly of an engine inner casing 14. An annular bypass flowpath 16 extends radially between the outer casing 12 and the engine inner casing 14 and all disposed about an axial or longitudinal centerline axis 11. Turbine blades 20 radially extend across a turbine flowpath 22 which encloses a hot working gas flow 26 in the turbine section 10. The turbine blades 20 are circumscribed by an annular top seal 24. An aft turbine frame 36, which exemplifies the gas turbine frame of the present invention, supports an aft bearing assembly 38 and a rotor 40 is rotatably mounted in the bearing assembly 38. The turbine blades 20 are operably connected in driving relationship to the rotor 40. Links 15 structurally connect the aft turbine frame 36 and the engine inner casing 14 to the engine outer casing 12.

Figure 3:
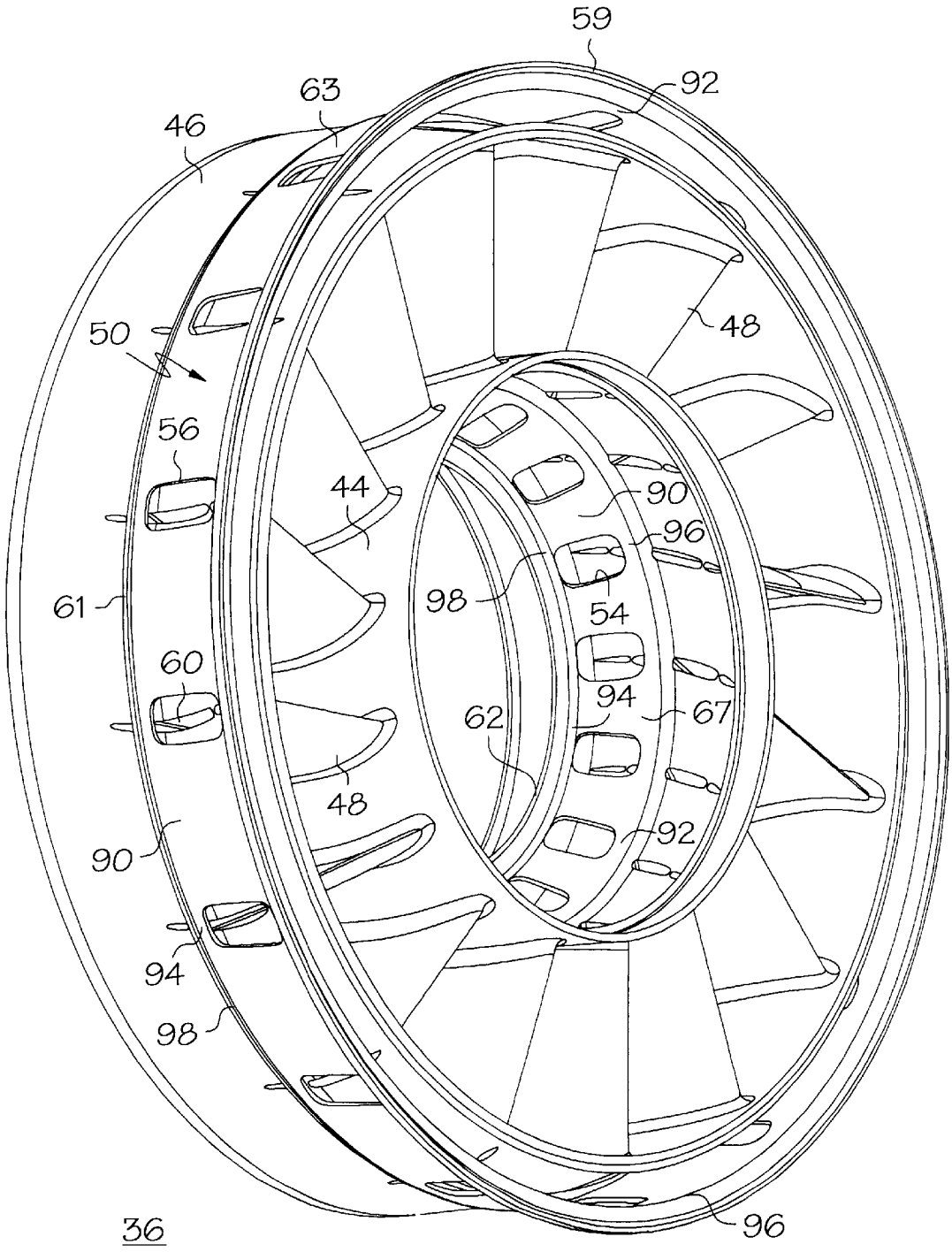
FIG. 3 is a perspective illustration of the turbine frame illustrated in FIG. 2.

Illustrated in FIGS. 1, 2, and 3, is a first exemplary embodiment of the present invention in which the gas turbine engine aft turbine frame 36 has inner and outer annular bands 44 and 46, respectively, joined together by generally radially extending struts 48 therebetween. Note that the struts 48 are also canted or tilted in the circumferential direction but are still conventionally referred to as being radially extending. A radially outer conical support arm 50 extends radially outwardly from the outer band 46 and a radially inner conical support arm 52 extends radially inwardly from the inner band 44. The radially outer conical support arm 50 has an annular forward flange 59, an annular outer footer 61 attached to the outer band 46, and an annular conical outer shell 63 extending between the forward flange and the outer footer. The radially inner conical support arm 52 has an annular aft flange 62, an annular inner footer 65 attached to the inner band 44, and an annular conical inner shell 67 extending between the aft flange and the inner footer. The forward flange 59 is designed to be bolted to the engine inner casing 14 and the annular aft flange 62 is designed to be bolted to bearing support structure 69. The forward flange 59 of the frame is bolted into the inner casing 14 of the frame 36 and the links 15 are located aft of the outer band 46 and structurally connect the outer band 46 to the engine outer casing 12.

Circumferentially spaced apart inner and outer openings 54 and 56 are disposed in the inner and outer shells 67 and 63 of the inner and outer conical support arms 52 and 50, respectively. Each of the struts 48 has at least one radially extending hollow passage 60 which extends through the inner and outer bands 44 and 46. The frame 36 is a single piece integral casting. The inner and outer conical support arms 52 and 50 have an equal number of the inner and outer circumferentially spaced apart openings 54 and 56. The inner circumferentially spaced apart openings 54 are equi-angularly spaced apart and the outer circumferentially spaced apart openings 56 are equi-angularly spaced apart. Each pair of the inner and outer circumferentially spaced apart openings 54 and 56 are linearly aligned with the hollow passage 60 of a corresponding one of the struts 48. Other embodiments of the invention have frames 36 with either only inner or only outer circumferentially spaced apart openings 54 and 56 in a corresponding one of either the inner or outer conical support arms 52 and 50, respectively.

The hollow passage 60 are used to pass sump service tubes 28 and other service lines and cooling air, if the turbine section 10 is so designed, across the turbine flowpath 22 and the hot working gas flow 26 contained therein. The service tubes 28 and other service lines may also be disposed through the outer openings 56 to facilitate the installation of the service lines and tubes. Though not illustrated herein, inner openings 54 may also have service lines and tubes disposed therethrough.

Figure 4:
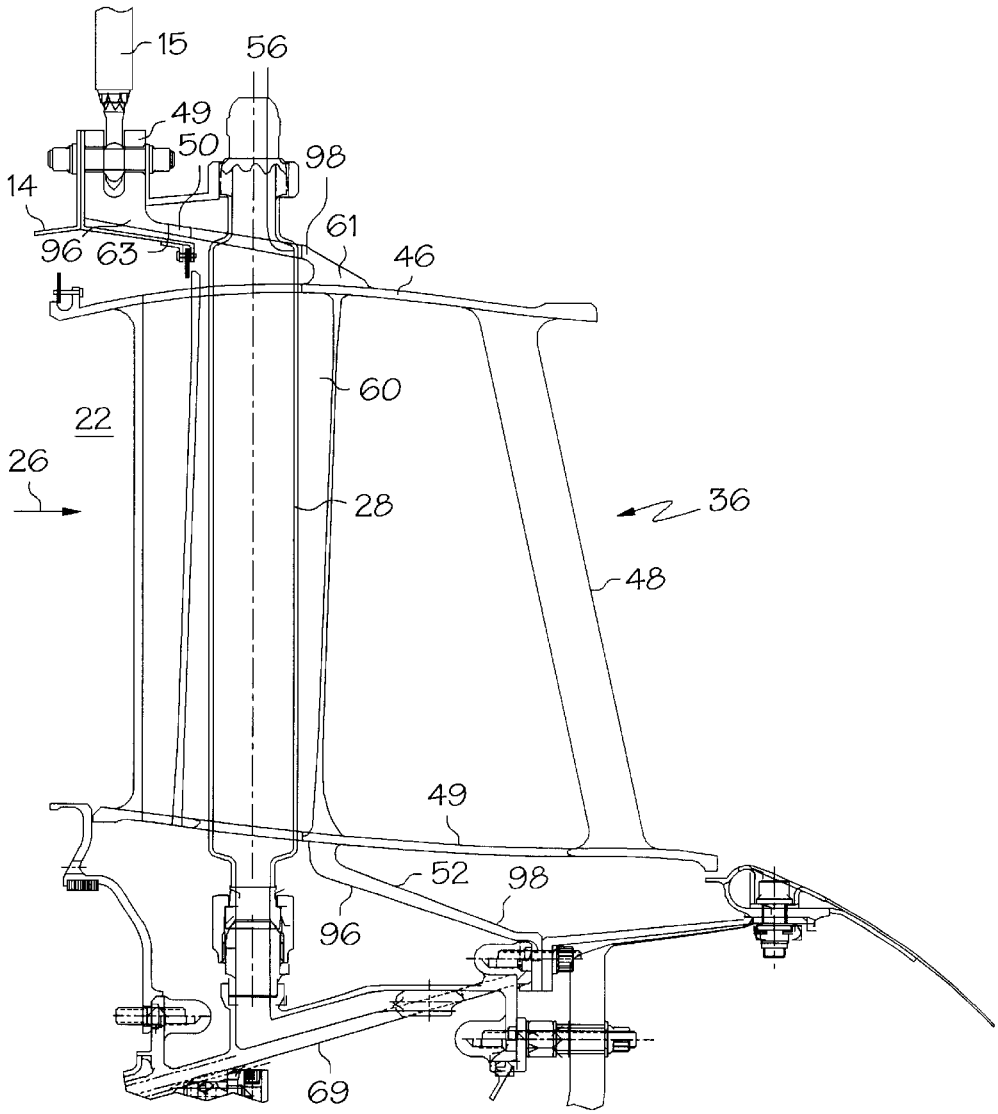
FIG. 4 is a more detailed cross-sectional view illustration of a portion of the engine and turbine frame illustrated in FIG. 1 with the links extending radially between a radially outer conical support arm of the frame and the engine outer casing.

Axially extending beams 90 are located between the openings in the outer and inner shells 63 and 67 and extend between forward and aft headers 92 and 94 at forward and aft ends 96 and 98, respectively, of the shells. The beams 90 can have different shapes and sizes depending on the sizes and shapes of the openings and other factors that the engineers may wish to take into account. The links 15 are bolted to devises 49 to structurally connect the aft turbine frame 36 and the engine inner casing 14 to the engine outer casing 12. The exemplary embodiment in FIG. 2 illustrates the devises 49 on the outer band 46 and integrally cast with the frame 36. An alternative embodiment illustrated in FIG. 4 has the devises 49 on the radially outer conical support arm 50 and integrally cast with the frame 36.

In the first exemplary embodiment of the invention illustrated in FIGS. 3, 6, 7 and 9, each opening has a substantially axially elongated rectangular platform shape 64 with forward and aft rounded ends 68 and 70, respectively, which may also be described as a racetrack shape.

Figure 10:
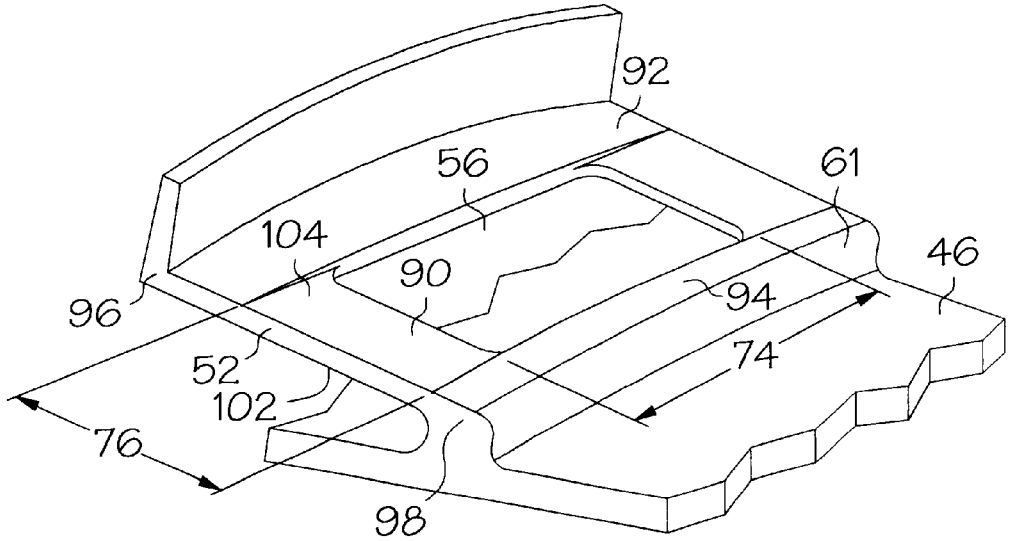
FIG. 10 is a perspective view illustration of third exemplary circumferentially spaced apart outer openings in the radially outer conical support arm having radially inwardly and outwardly facing flat surfaces on beams between rectangular openings of the frame that are wider than the openings illustrated in FIG. 9.

Illustrated in FIG. 10 is an alternative rectangular shape 64 for the outer opening 56 and has a circumferentially extending width 74 that is larger than its axially extending length 76. The annular conical outer and inner shells 63 and 67 are circular in cross-section and the beams 90 are rectangular in cross-section having radially inwardly and outwardly facing flat surfaces 102 and 104. The flat beams provide additional radial flexibility.

Figure 8:
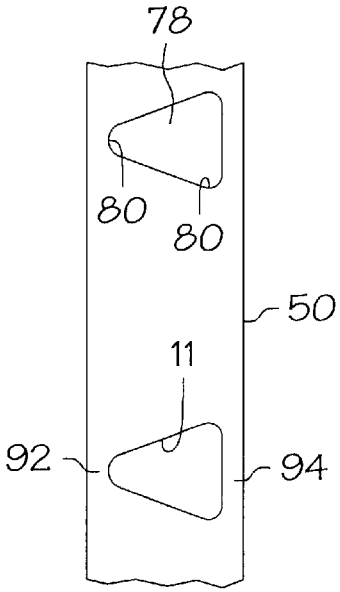
FIG. 8 is a platform view illustration of second exemplary circumferentially spaced apart triangular outer openings in the radially outer conical support arm of the frame.
Figure 9:
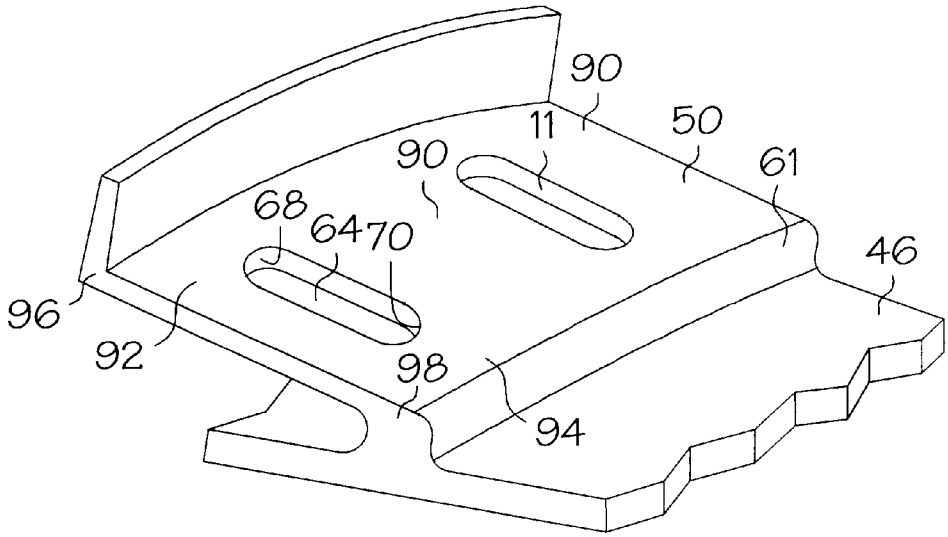
FIG. 9 is a perspective view illustration of the first exemplary circumferentially spaced apart outer openings in the radially outer conical support arm of the frame.
Figure 11:
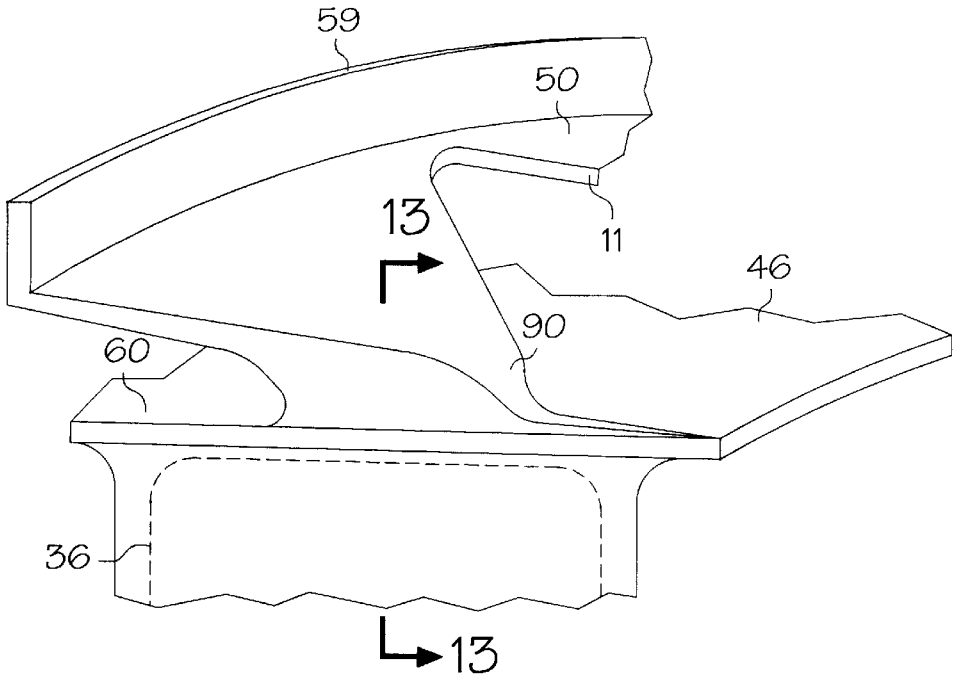
FIG. 11 is a perspective view illustration of a portion of the radially outer conical support arm and frame with the triangular outer openings illustrated in FIG. 8.
Figure 12:
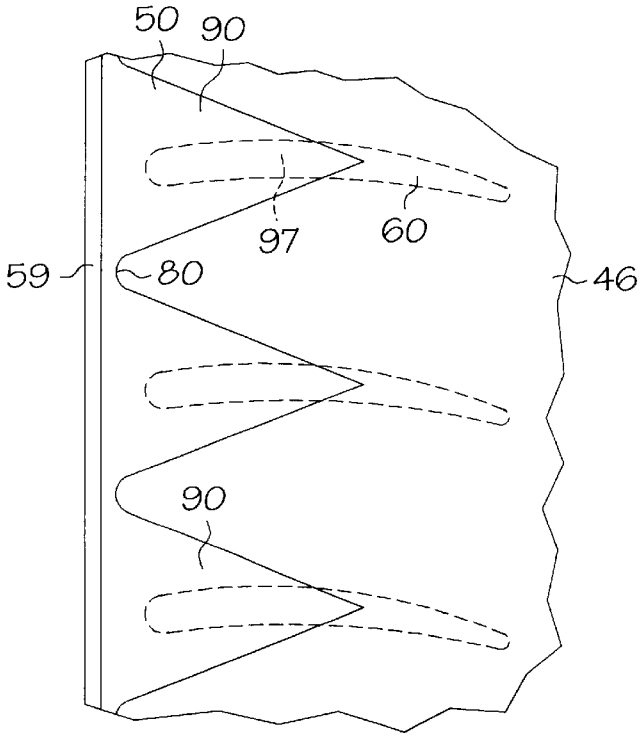
FIG. 12 is a radially inwardly looking view illustration of the portion of the outer conical support arm and the frame illustrated in FIG. 11.
Figure 13:
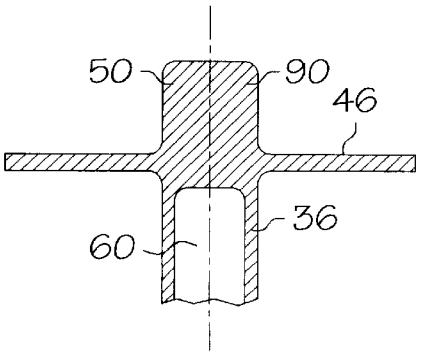
FIG. 13 is a cross-sectional view illustration of the portion of the outer conical support arm and the frame through 13—13 illustrated in FIG. 11.

Illustrated in FIGS. 8 and 11 is another embodiment of the invention wherein the outer opening 56 has a substantially triangular platform shape 78 with filleted corners 80. Another alternative design illustrated in FIGS. 11, 12 and 13 illustrate the beams 90 linearly aligned with or covering over a forward portion 97 of the hollow passages 60 of corresponding ones of the struts 48.

Figure 5:
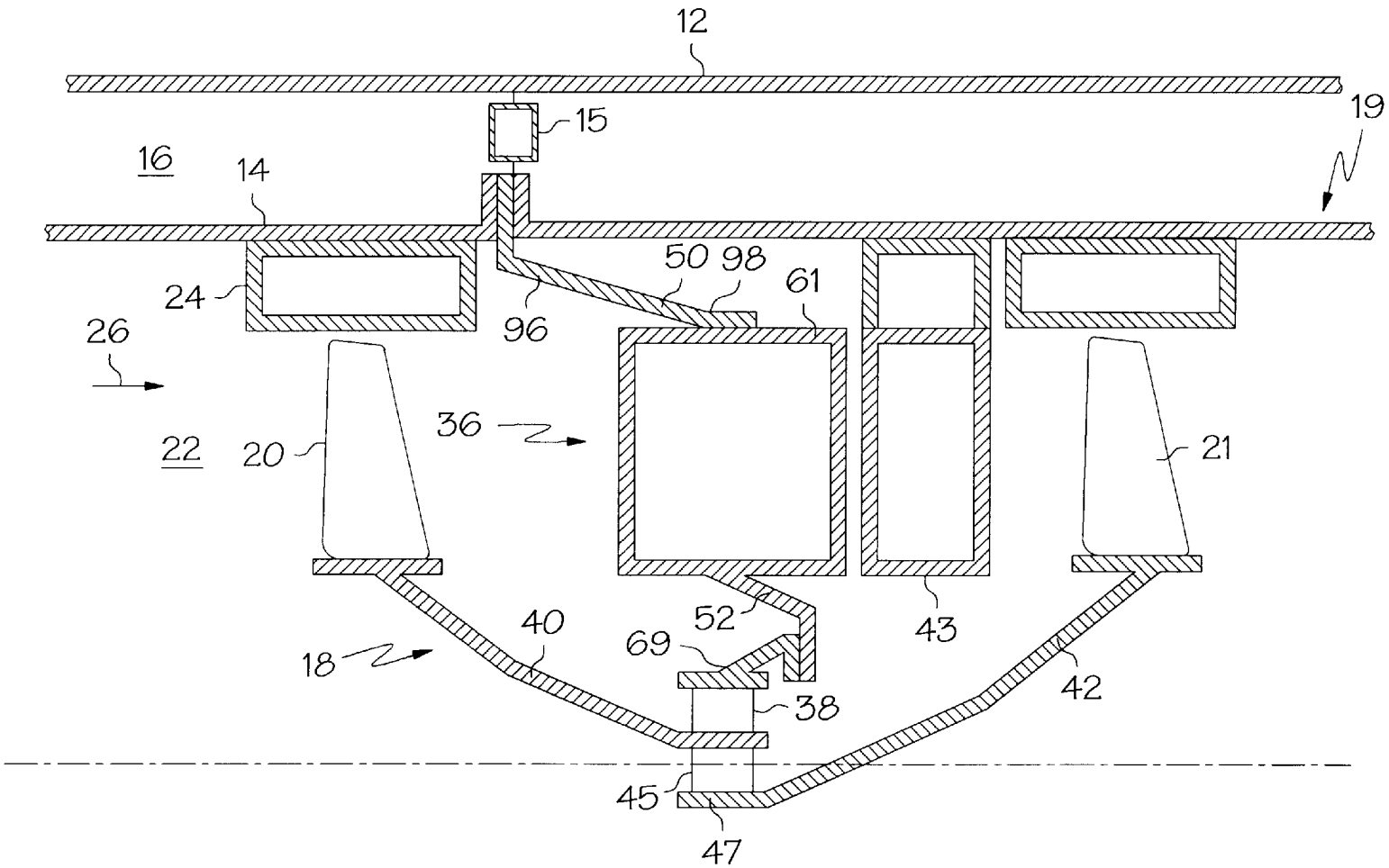
FIG. 5 is a schematic illustration of an alternative axial flow gas turbine engine including a turbine stage aft or downstream of the turbine frame of the present invention.
Figure 6:
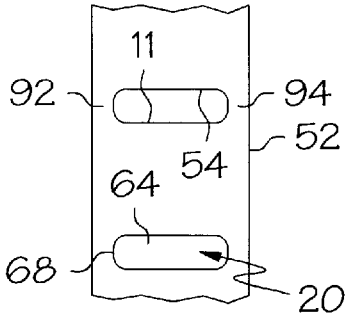
FIG. 6 is a platform view illustration of first exemplary circumferentially spaced apart inner openings in a radially inner conical support arm of the frame.
Figure 7:
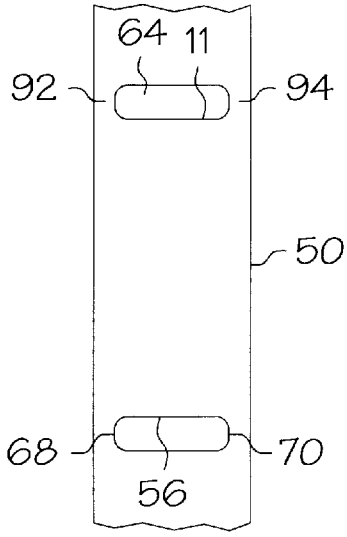
FIG. 7 is a platform view illustration of first exemplary circumferentially spaced apart outer openings in the radially outer conical support arm of the frame.

Illustrated schematically in FIG. 5 is an alternative embodiment of the invention in which the turbine section 10 has low pressure forward first and aft turbine stages 18 and 19 driving low pressure first and second rotors 40 and 42, respectively. The aft turbine stage 19 has low pressure aft turbine blades 21 mounted on the second rotor 42 downstream of the turbine blades 20. A low pressure stage of vanes 43 are disposed across the turbine flowpath 22 between the struts 48 and the low pressure aft turbine blades 21. An intershaft bearing 45 is disposed between the low pressure first and second rotors 40 and 42, respectively. The aft turbine stage 19 may be a free or power turbine and the second rotor 42 can be used to drive a power shaft 47 that may be used to power a lift fan or other device or machinery.

While there have been described herein what are considered to be preferred and exemplary embodiments of the present invention, other modifications of the invention shall be apparent to those skilled in the art from the teachings herein and, it is therefore, desired to be secured in the appended claims all such modifications as fall within the true spirit and scope of the invention. Accordingly, what is desired to be secured by Letters Patent of the United States is the invention as defined and differentiated in the following claims.

What is claimed is:

1. A gas turbine frame comprising:

radially inner and outer annular bands joined together by radially extending struts therebetween, radially outer conical support arm extending radially outwardly from said outer band, radially inner conical support arm extending radially inwardly from said inner band, and inner and outer circumferentially spaced apart openings in said inner and outer conical support arms.

2. A frame as claimed in claim 1 wherein each of said struts has at least one radially extending hollow passage therethrough and extending through said bands.

3. A frame as claimed in claim 2 wherein said frame is a single piece integral casting.

4. A frame as claimed in claim 3 further comprising an equal number of said inner and outer circumferentially spaced apart openings wherein said inner circumferentially spaced apart openings are equi-angularly spaced apart and said outer circumferentially spaced apart openings are equi-angularly spaced apart.

5. A frame as claimed in claim 4 further wherein each pair of said inner and outer circumferentially spaced apart openings are linearly aligned with one of said struts.

6. A frame as claimed in claim 2 wherein each opening has a substantially rectangular platform shape with rounded forward and aft ends.

7. A frame as claimed in claim 2 wherein each opening has a substantially triangular platform shape with filleted corners.

8. A frame as claimed in claim 2 wherein each opening has a substantially rectangular platform shape with beams between the openings said beams having inwardly and outwardly facing flat surfaces.

9. A frame as claimed in claim 1 wherein said frame is a single piece integral casting.

10. A frame as claimed in claim 9 further comprising an equal number of said inner and outer circumferentially spaced apart openings wherein said inner circumferentially spaced apart openings are equi-angularly spaced apart and said outer circumferentially spaced apart openings are equi-angularly spaced apart.

11. A frame as claimed in claim 10 further wherein each pair of said inner and outer circumferentially spaced apart openings are linearly aligned with one of said struts.

12. A frame as claimed in claim 11 wherein each opening has a substantially rectangular platform shape with rounded forward and aft ends.

13. A frame as claimed in claim 11 wherein each opening has a substantially triangular platform shape with filleted corners.

14. A frame as claimed in claim 11 wherein each opening has a substantially rectangular platform shape with beams between the openings said beams having inwardly and outwardly facing flat surfaces.

15. A frame as claimed in claim 1 wherein said radially outer conical support arm extends radially outwardly from said outer band in an axially forward direction and said radially inner conical support arm extends radially inwardly from said inner band in an axially aft direction.

16. A frame as claimed in claim 15 wherein each of said struts has at least one radially extending hollow passage therethrough and extending through said bands.

17. A frame as claimed in claim 16 wherein said frame is a single piece integral casting.

18. A frame as claimed in claim 17 further comprising an equal number of said inner and outer circumferentially spaced apart openings wherein said inner circumferentially spaced apart openings are equi-angularly spaced apart and said outer circumferentially spaced apart openings are equi-angularly spaced apart.

19. A frame as claimed in claim 18 further wherein each pair of said inner and outer circumferentially spaced apart openings are linearly aligned with one of said struts.

20. A frame as claimed in claim 19 wherein each opening has a substantially rectangular platform shape with rounded forward and aft ends.

21. A frame as claimed in claim 19 wherein each opening has a substantially triangular platform shape with filleted corners.

22. A frame as claimed in claim 19 wherein each opening has a substantially rectangular platform shape with beams between the openings said beams having inwardly and outwardly facing flat surfaces.

23. A gas turbine assembly comprising:

a gas turbine frame comprising;

radially inner and outer annular bands joined together by radially extending struts therebetween, radially outer conical support arm extending radially outwardly from said outer band, radially inner conical support arm extending radially inwardly from said inner band, and inner and outer circumferentially spaced apart openings in said inner and outer conical support arms;

a turbine outer casing within and to which said gas turbine frame is mounted; and a bearing assembly mounted within said radially inner conical support arm.

24. A gas turbine assembly as claimed in claim 23 wherein said radially outer conical support arm extends radially outwardly from said outer band in an axially forward direction and said radially inner conical support arm extends radially inwardly from said inner band in an axially aft direction.

25. A gas turbine assembly as claimed in claim 24 wherein each of said struts has at least one radially extending hollow passage therethrough and extending through said bands.

26. A gas turbine assembly as claimed in claim 25 wherein said frame is a single piece integral casting.

27. A gas turbine assembly as claimed in claim 26 further comprising an equal number of said inner and outer circumferentially spaced apart openings wherein said inner circumferentially spaced apart openings are equi-angularly spaced apart and said outer circumferentially spaced apart openings are equi-angularly spaced apart.

28. A gas turbine assembly as claimed in claim 27 wherein each pair of said inner and outer circumferentially spaced apart openings are linearly aligned with one of said struts.

29. A gas turbine assembly as claimed in claim 26 wherein each opening has a substantially rectangular platform shape with rounded forward and aft ends.

30. A gas turbine assembly as claimed in claim 26 wherein each opening has a substantially triangular platform shape with filleted corners.

31. A gas turbine assembly as claimed in claim 26 wherein each opening has a substantially rectangular platform shape with beams between the openings said beams having inwardly and outwardly facing flat surfaces.

32. A gas turbine assembly as claimed in claim 26 wherein said gas turbine frame is mounted to said turbine outer casing with links.

33. A gas turbine assembly as claimed in claim 24 wherein at least one of said struts has at least one radially extending hollow passage therethrough and extending through said bands and at least one service line passing through said one of said struts and through at least one of said openings in said radially outer conical support arm and another one of said openings in said radially inner conical support arm.

34. A gas turbine assembly as claimed in claim 33 wherein said frame is a single pierce integral casting.

35. A gas turbine assembly as claimed in claim 34 further comprising an equal number of said inner and outer circumferentially spaced apart openings wherein said inner circumferentially spaced apart openings are equi-angularly spaced apart and said outer circumferentially spaced apart openings are equi-angularly spaced apart.

36. A gas turbine assembly as claimed in claim 35 wherein each pair of said inner and outer circumferentially spaced apart openings are linearly aligned with one of said struts.

37. A gas turbine assembly as claimed in claim 35 wherein each opening has a substantially rectangular platform shape with rounded forward and aft ends.

38. A gas turbine assembly as claimed in claim 35 wherein each opening has a substantially triangular platform shape with filleted corners.

39. A gas turbine assembly as claimed in claim 35 wherein each opening has a substantially rectangular platform shape with beams between the openings said beams having inwardly and outwardly facing flat surfaces.

40. A gas turbine frame comprising:

radially inner and outer annular bands joined together by radially extending struts therebetween, radially outer conical support arm extending radially outwardly from said outer band, and outer circumferentially spaced apart openings in said radially outer conical support arm.

41. A frame as claimed in claim 33 wherein each of said struts has at least one radially extending hollow passage therethrough and extending through said bands.

42. A frame as claimed in claim 34 wherein said frame is a single piece integral casting.

43. A frame as claimed in claim 35 wherein said outer circumferentially spaced apart openings are equi-angularly spaced apart.

44. A frame as claimed in claim 36 further wherein each of said outer circumferentially spaced apart openings are linearly aligned with one of said struts.

45. A frame as claimed in claim 44 wherein each opening has a substantially rectangular platform shape with rounded forward and aft ends.

46. A frame as claimed in claim 44 wherein each opening has a substantially triangular platform shape with filleted corners.

47. A frame as claimed in claim 46 further comprising triangular beams between said openings wherein said beams cover over forward portions of said hollow passages of corresponding ones of said struts.

48. A frame as claimed in claim 44 wherein each opening has a substantially rectangular platform shape with beams between the openings said beams having inwardly and outwardly facing flat surfaces.

49. A gas turbine frame comprising:

radially inner and outer annular bands joined together by radially extending struts therebetween, radially inner conical support arm extending radially inwardly from said inner band, and inner circumferentially spaced apart openings in said radially inner conical support arm.

50. A frame as claimed in claim 49 wherein said frame is a single piece integral casting.

51. A frame as claimed in claim 50 wherein said inner circumferentially spaced apart openings are equi-angularly spaced apart.

52. A frame as claimed in claim 51 wherein each opening has a substantially rectangular platform shape with rounded forward and aft ends.

53. A frame as claimed in claim 51 wherein each opening has a substantially triangular platform shape with filleted corners.

54. A frame as claimed in claim 51 wherein each opening has a substantially rectangular platform shape with beams between the openings said beams having inwardly and outwardly facing flat surfaces.

* * * * *

UNITED STATES PATENT AND TRADEMARK OFFICE

CERTIFICATE OF CORRECTION

PATENT NO. : 6,547,518 B1
DATED : April 15, 2003
INVENTOR(S) : Robert Paul Czachor et al.

It is certified that error appears in the above-identified patent and that said Letters Patent is hereby corrected as shown below:

Column 6,
Line 67, please change “pierce” to -- piece --.

Signed and Sealed this

Twenty-fourth Day of June, 2003

JAMES E. ROGAN
*Director of the United States Patent and Trademark Office*